US007789681B2

(12) United States Patent
Guan et al.

(10) Patent No.: US 7,789,681 B2
(45) Date of Patent: Sep. 7, 2010

(54) CARD EDGE CONNECTOR WITH AN IMPROVED LATCH

(75) Inventors: Hai-Fei Guan, Kunshan (CN); Xue-Wu Bu, Kunshan (CN); Ting-Shun Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 70 days.

(21) Appl. No.: 12/218,717

(22) Filed: Jul. 16, 2008

(65) Prior Publication Data

US 2009/0023308 A1 Jan. 22, 2009

(30) Foreign Application Priority Data

Jul. 16, 2007 (CN) ..... 2007 2 0040750 U

(51) Int. Cl.
*H01R 12/18* (2006.01)

(52) U.S. Cl. ..... 439/157

(58) Field of Classification Search ..... 439/157, 439/62, 237, 327, 347, 358, 328, 629, 155, 439/160

See application file for complete search history.

(56) References Cited

U.S. PATENT DOCUMENTS 4,241,966 A * 12/1980 Gomez ..... 439/157
5,468,156 A * 11/1995 Flinchbaugh et al. ..... 439/157
5,634,803 A 6/1997 Cheng et al.
6,290,519 B1 9/2001 Lee
2006/0035493 A1* 2/2006 Jiang ..... 439/157
2008/0318448 A1* 12/2008 Ringler et al. ..... 439/78

* cited by examiner

*Primary Examiner*—Alexander Gilman
(74) *Attorney, Agent, or Firm*—Wei Te Chung; Andrew C. Cheng; Ming Chieh Chang

(57) ABSTRACT

A card edge connector (100) for receiving a module (200) includes an elongated insulative housing (1) having a pair of elongated side walls, a central slot (11) extending therebetween for insertion of the module, and a receiving slot (14) formed on one of the side walls and communicating with the central slot. A group of terminals (2) are positioned in the side walls and extend into the central slot thereof. A latch (3) is rotatably received in the receiving slot for locking the module in the insulative housing at a first position and for ejecting the module out of the insulative housing at a second position. The latch has a main body (30) and a stopping device (31) projecting from the main body to engage with an upper surface (17) of the insulative housing when the latch is at the first and second position, thereby preventing the latch from over-rotating beyond the first and second positions.

18 Claims, 7 Drawing Sheets

CARD EDGE CONNECTOR WITH AN IMPROVED LATCH

BACKGROUND OF THE INVENTION

1. Field of the Invention

The present invention generally relates to a card edge connector for receiving a module and more particularly to a card edge connector having a latch for removing the module from the card edge connector.

2. Description of Related Art

A conventional card edge connector is fixed in an electronic device such as a computer for receiving a memory module. Such connector is mounted on a printed circuit board (PCB), and comprises an elongated insulative housing, a plurality of terminals received therein and a pair of latches attached thereto. The insulative housing has a central slot extending along its lengthwise direction for receiving the memory module. The insulative housing has a pair of towers integrally formed on two opposite ends thereof. Each tower has a receiving slot. The latches which are rotatably received in the receiving slot could be rotated inwardly for locking the memory module in the insulative housing and outwardly for ejecting the memory module out of the insulative housing.

However, the latches are rotatably received in the receiving slots which are formed on two lengthwise opposite ends of the insulative housing. The latches which are rotated along the lengthwise direction of the insulative housing will occupy too much space of the electronic device in the lengthwise direction.

Hence, an improvement over the prior art is required to overcome the problems thereof.

SUMMARY OF THE INVENTION

According one aspect of the present invention, a card edge connector for receiving a module comprises an elongated insulative housing having a pair of elongated side walls, a central slot extending therebetween for insertion of the module, and a receiving slot formed on one of the side walls and communicating with the central slot. A plurality of terminals are positioned in the side walls and extend into the central slot thereof. A latch is rotatably received in the receiving slot for locking the module in the insulative housing at a first position and for ejecting the module out of the insulative housing at a second position. The latch has a main body and a stopping device projecting from the main body to engage with an upper surface of the insulative housing when the latch is at the first and second position, thereby preventing the latch from over-rotating beyond the first and second positions.

According to another aspect of the present invention, a card edge connector for receiving a module comprises an elongated insulative housing having a pair of elongated side walls, a central slot extending therebetween for insertion of the module, and a receiving slot formed on one of the side walls and communicating with the central slot. A plurality of terminals are positioned in the side walls and extend into the central slot thereof. A latch rotatably engages with the receiving slot. The latch has a first and a second locking portion both for locking the module in the insulative housing and a ejecting portion for ejecting the module out of the insulative housing.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
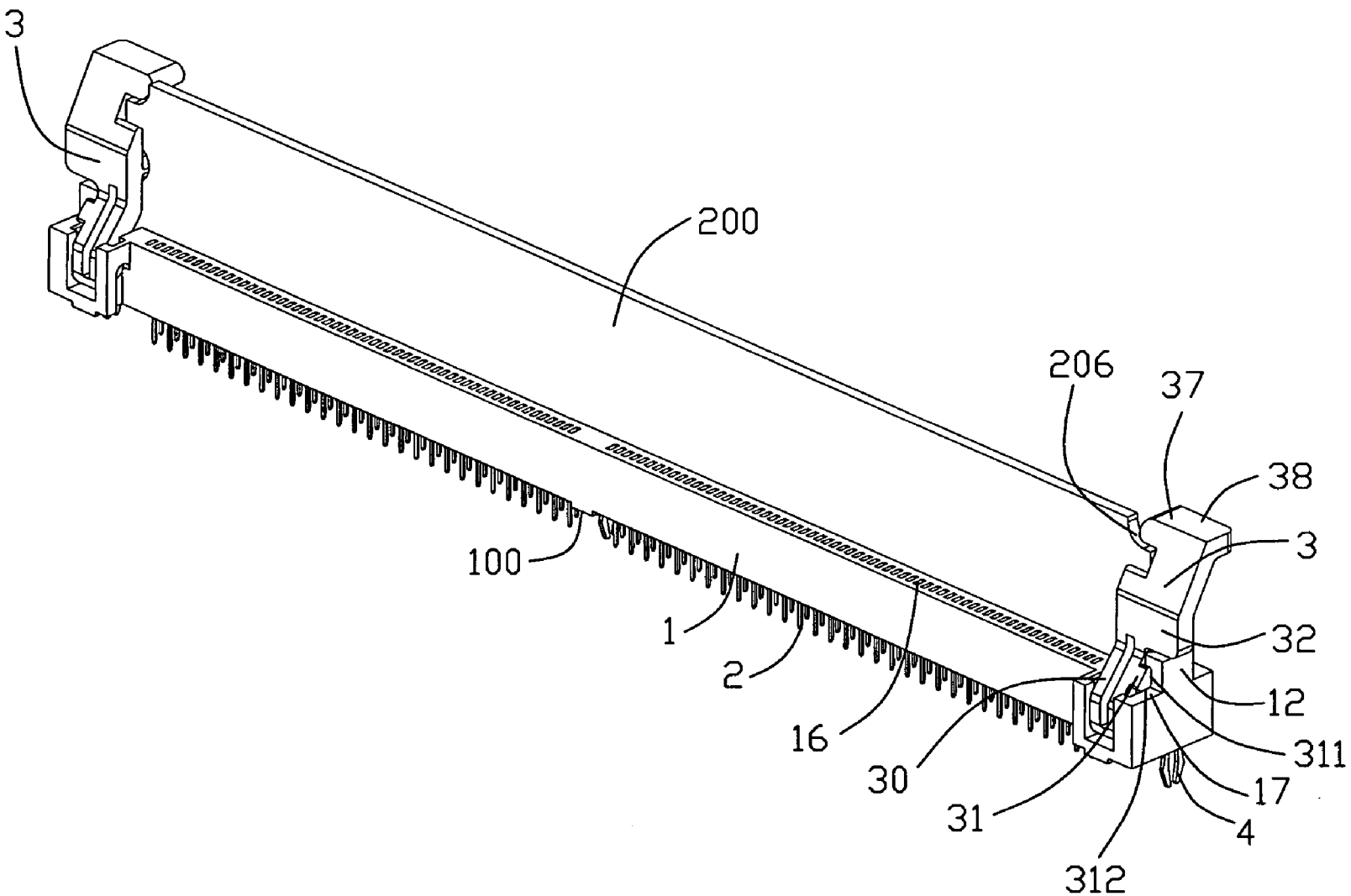
FIG. 1 is a perspective view of a card edge connector and a memory module to be received therein according to the present invention.

Reference will now be made to the drawing figures to describe the preferred embodiment of the present invention in detail.

Figure 2:
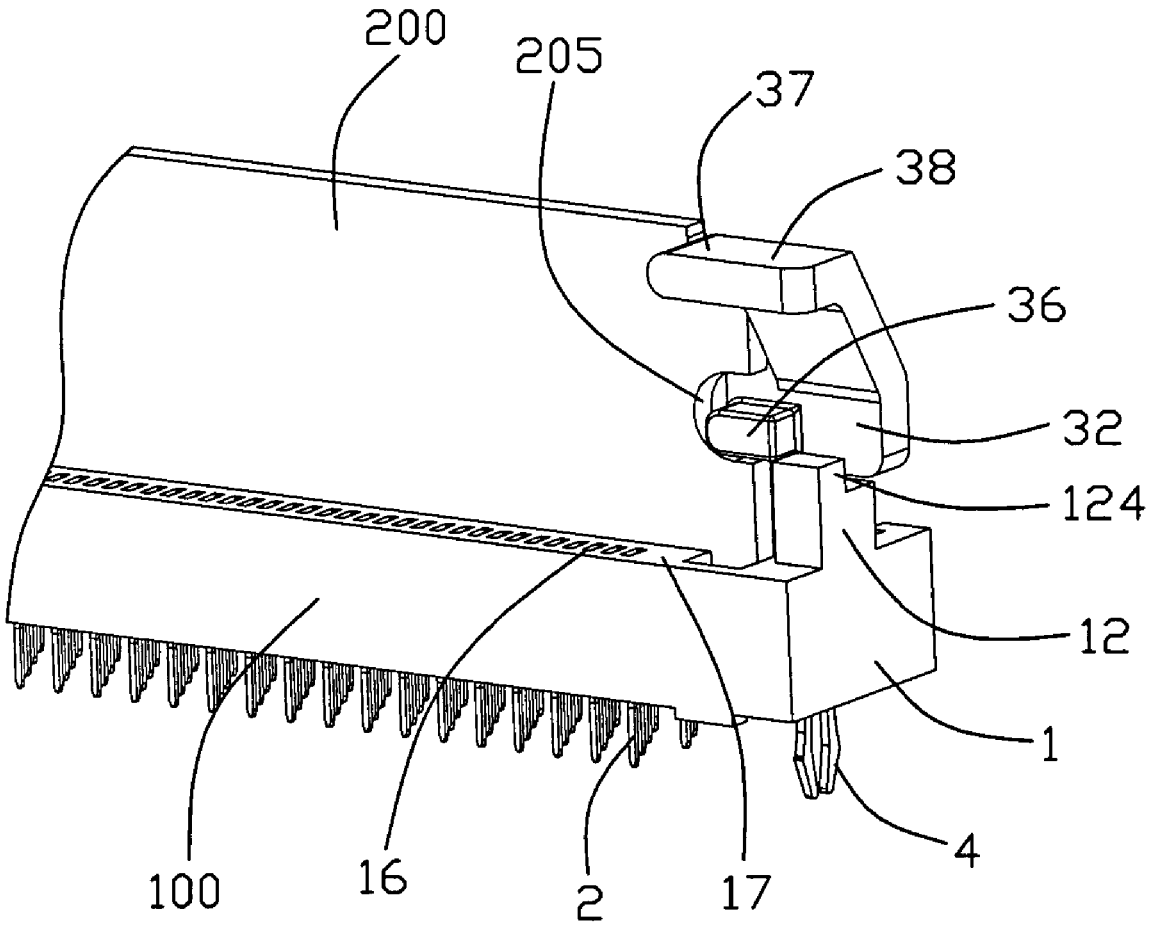
FIG. 2 is another perspective view of the card edge connector shown in FIG. 1.

Referring to FIGS. 1-2, the card edge connector 100 according to the present invention used for receiving a memory module 200, comprises an elongated insulative housing 1, a plurality of terminals 2 mounted on the insulative housing 1, a pair of board locks 4 disposed in the insulative housing 1 and a pair of latches 3 rotatably attached to the insulative housing 1.

Figure 3:
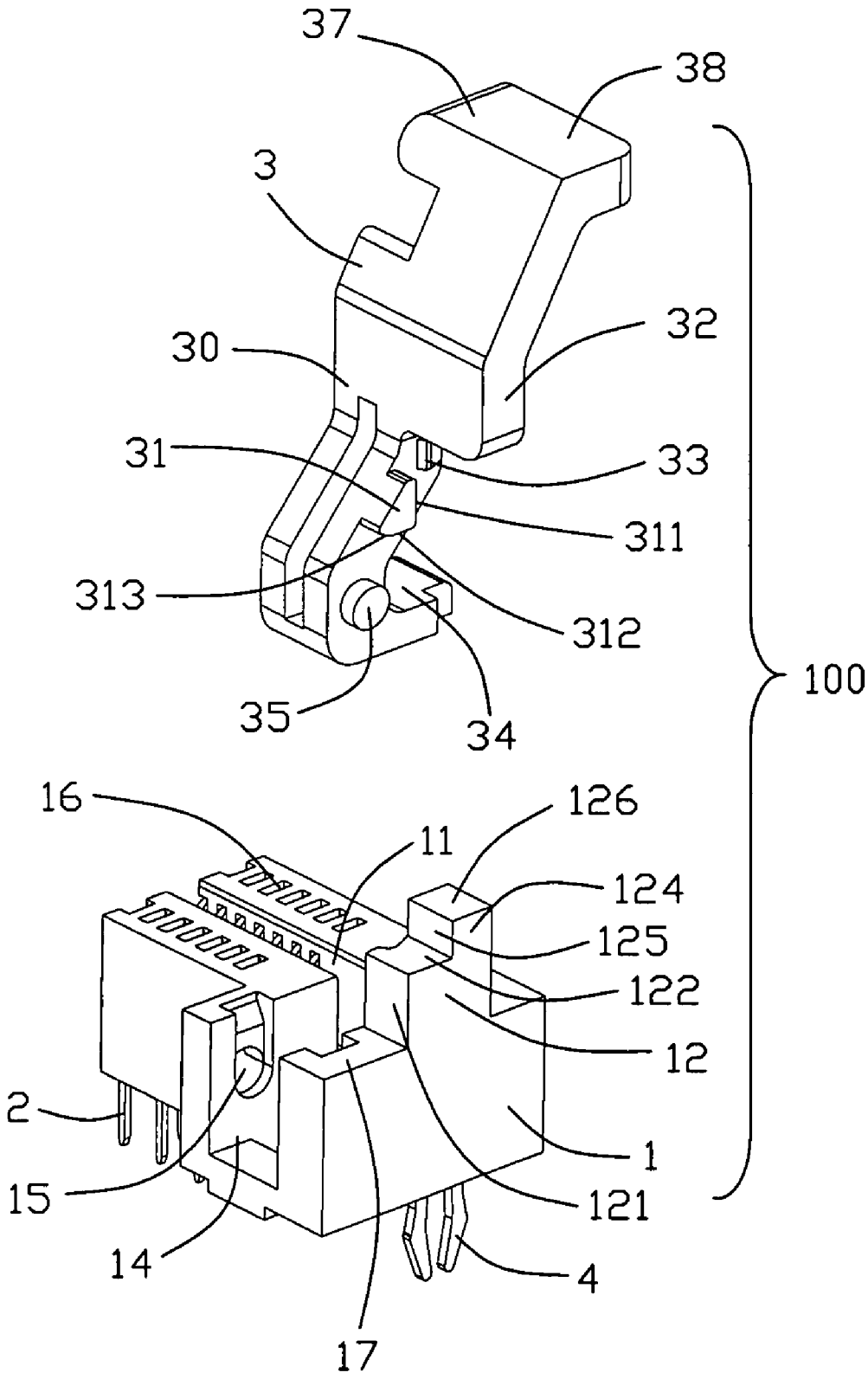
FIG. 3 is a partly exploded perspective view of the card edge connector shown in FIG. 1.
Figure 4:
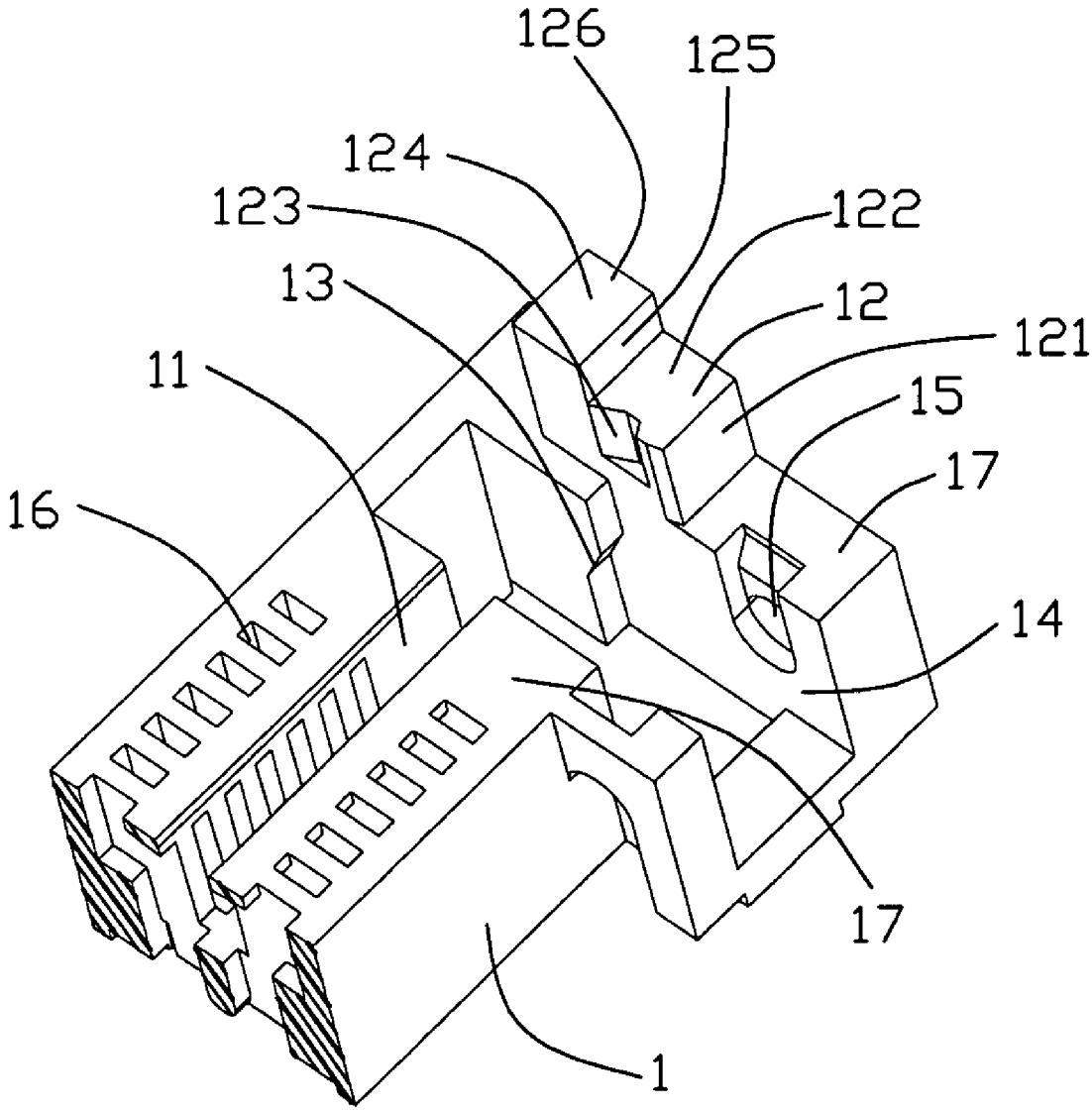
FIG. 4 is a partly perspective view of an insulative housing of the card edge connector shown in FIG. 1.
Figure 5:
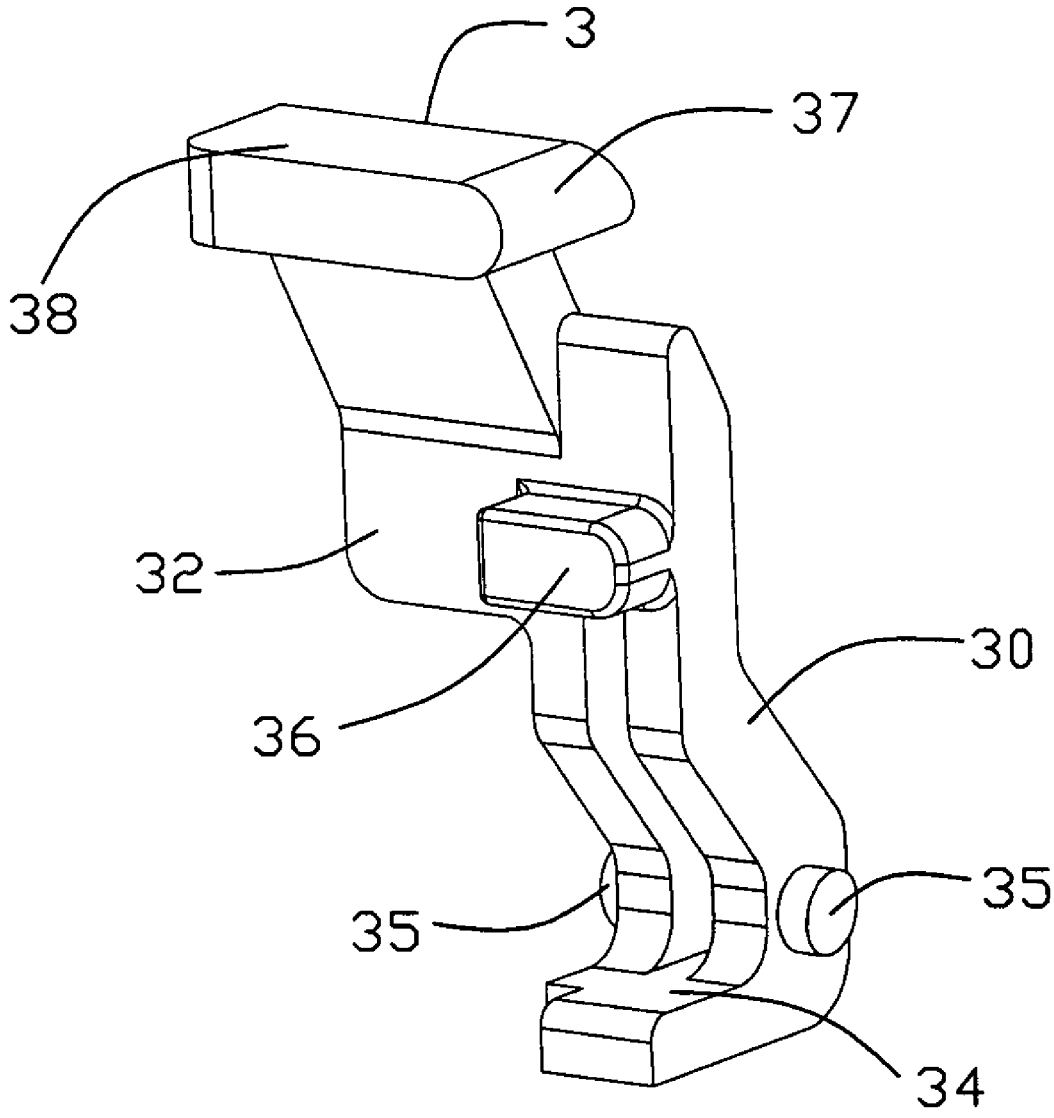
FIG. 5 is a perspective view of a latch of the card edge connector shown in FIG. 1.
Figure 6:
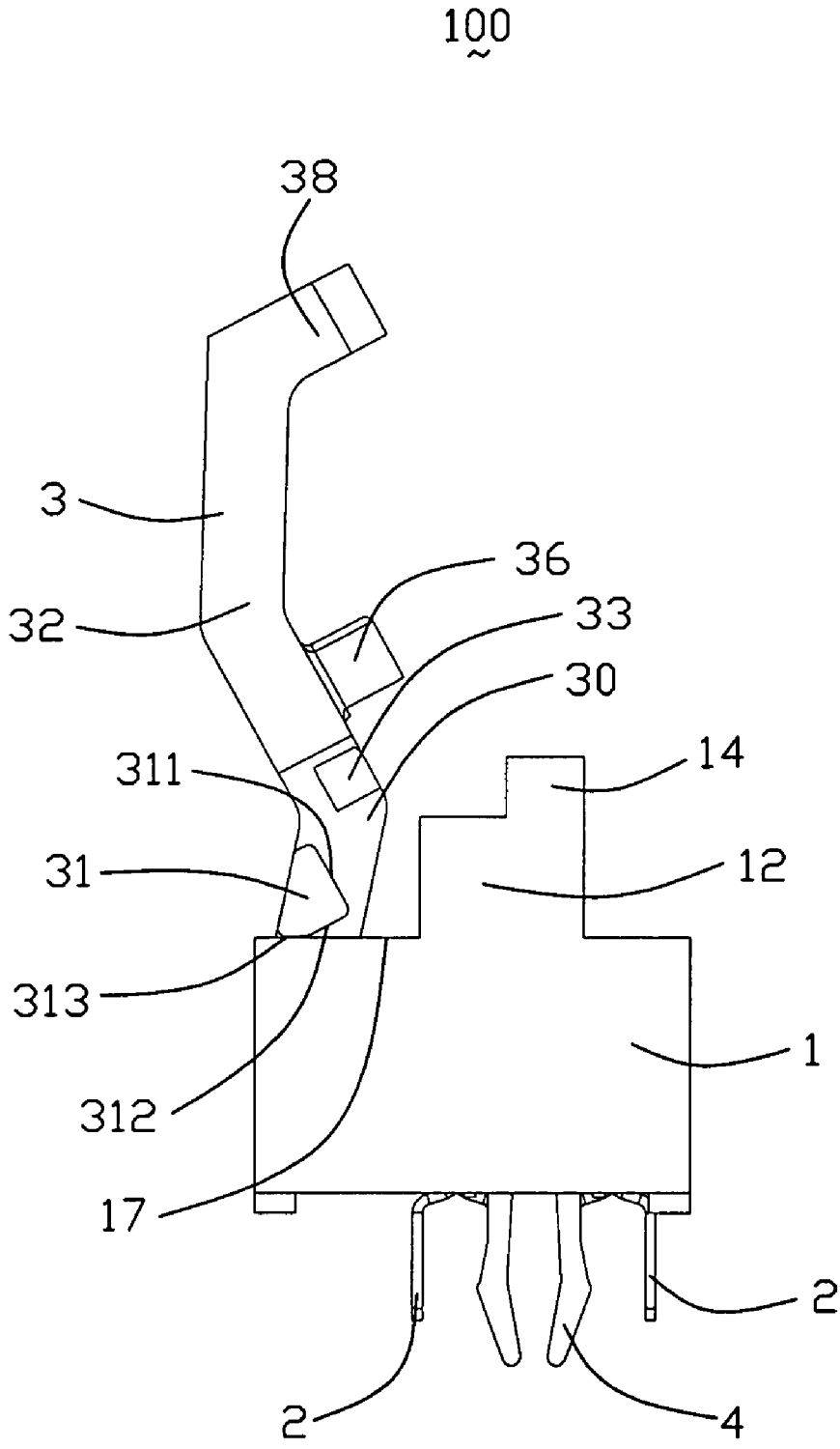
FIG. 6 is a right side elevational view of the card edge connector shown in FIG. 1.
Figure 7:
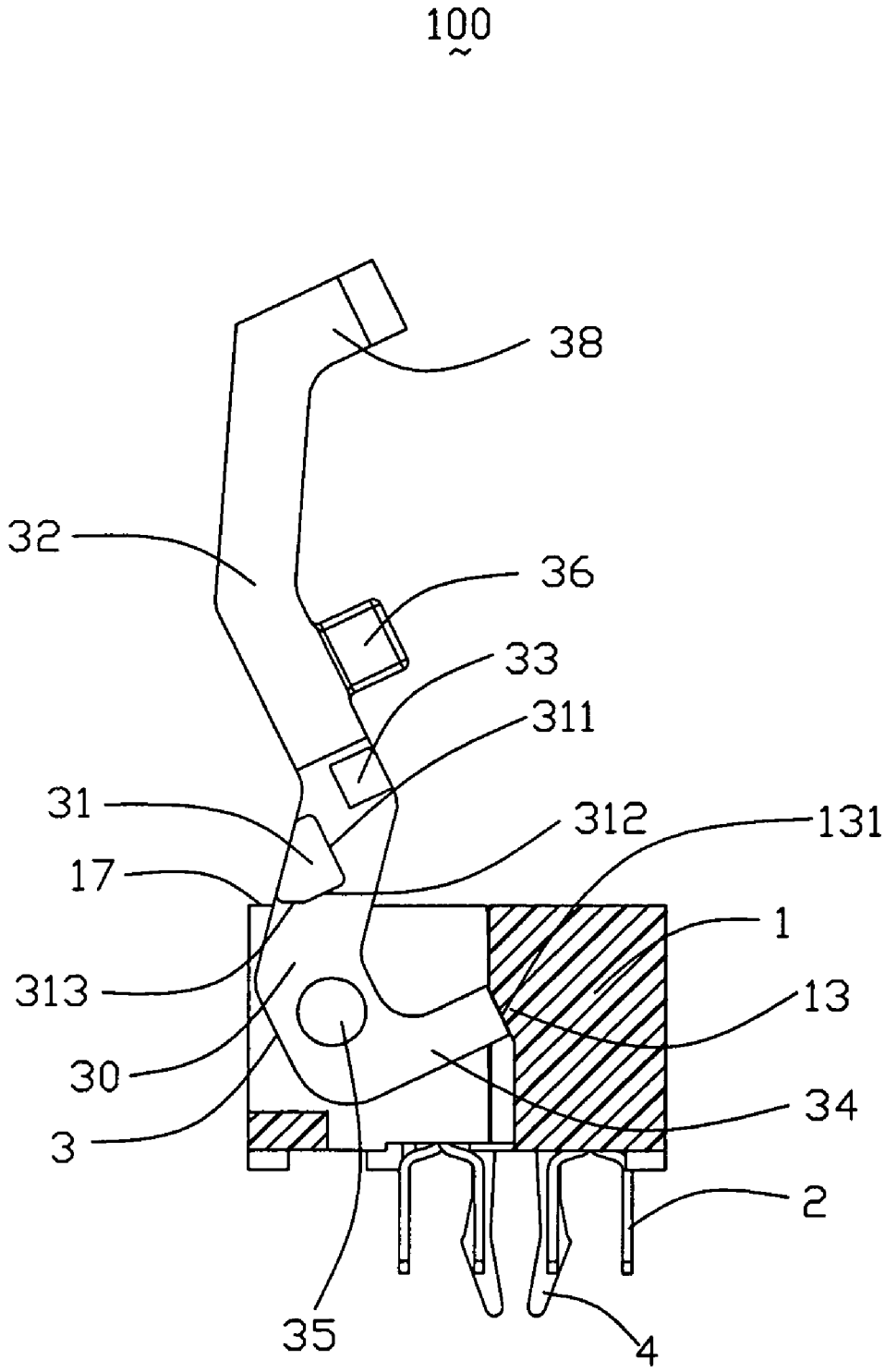
FIG. 7 is a partly cross-sectional view of FIG. 6.

Referring to FIGS. 1, 3 and 4, the insulative housing 1 has a pair of elongated side walls formed with a plurality of channels 16 for receiving the terminals 2, a central slot 11 extending therebetween for receiving the memory module 200 and a pair of receiving slots 14 formed on one of the side walls and communicating with the central slot 11. The terminals 2 extend into the central slot 11 for electrically and mechanically engaging with the memory module 200. The receiving slots 14 are perpendicular to the central slot 11 in its lengthwise direction. The side wall has a pair of holes 15 communicating with the corresponding receiving slot 14. The insulative housing 1 has an engaging block 13 extending into the central slot 11 and defining an oblique surface 131. A pair of standoffs 12 extend upwardly from two lengthwise ends of an upper surface 17 of the insulative housing 1. Each standoff 12 has a rear surface 121 and a top surface 122. The standoff 12 has a backstop 124 extending upwardly from the top surface 122 and a cavity 123 formed on an inner side thereof. The backstop 124 has a rear surface 125 and a top surface 126. The upper surface 17, the rear and top surface 121, 122 of the standoff 12, and the rear and top surface 125, 126 of the backstop 124 all commonly present as a ladder shape.

Referring to FIGS. 1-7. Each latch 3 includes a main body 30 retained in the receiving slot 14 and having a pair of spindles 35 formed on opposite sides thereof for rotatably insertion into the holes 15 of the insulative housing 1. Therefore, the latch 3 could rotatably engage with the receiving slot 14 in a direction perpendicular to the elongated insulative housing 1, and the lengthwise dimension of the card edge connector 100 can be decreased. The latch 3 has an ejecting portion 34 extending forwardly from a lower end of the main body 30, a first locking portion 36 extending from a front surface of the main body 30 and a stopping plate 32 extending laterally from one side of the main body 30. An actuating portion 38 extends forwardly from an upper end of the stopping plate 32 for facilitating urging the latch 3. A second locking portion 37 extends inwardly from one side of the actuating portion 38.

When the memory module 200 is inserted into the central slot 11 of the insulative housing 1 so as to make an electrical and mechanical connection with the terminals 2 for signal transmission therebetween, the latch 3 is rotated forwardly to a first position at which the first locking portion 36 is locked with a recess 205 on one side of the memory module 200, meanwhile the second locking portion 37 is locked with a notch 206 above the recess 205 of the memory module 200. The first and second locking portion 36, 37 both lock with the memory module 200 in the insulative housing 1 to make the memory module 200 retained in the insulative housing 1 firmly.

When the memory module 200 is to be ejected out of the insulative housing 1, the actuating portion 38 is pulled backwardly and drives the latch 3 rotatable to a second position at which the ejecting portion 34 ejects the memory module 200 out of the central slot 11. The latch 3 has a stopping device 31 formed on one side of the main body 30 above the spindle 35. The stopping device 31 forms an upright surface 311, a horizontal surface 312 extending from a lower end of the upright surface 311, and a slanted surface 313 extending obliquely and upwardly from a rear end of the horizontal surface 312 at a predetermined angle.

When the latch 3 is rotated forwardly at the first position, the upright surface 311 abuts against the rear surface 121 of the standoff 12, the horizontal surface 312 abuts against the upper surface 17 of the insulative housing 1, and the stopping plate 32 abuts against the rear surface 125 the backstop 124. Thereby, the latch 3 could be prevented from forward over-rotation more effectively.

When the latch 3 is rotated backwardly at the second position, the slanted surface 313 abuts against the upper surface 17 of the insulative housing 1. At the same time, the ejecting portion 34 is raised and abuts against the oblique surface 131 of the engaging block 13 for preventing the latch 3 from backward over-rotation. The engagement between the slanted surface 313 and the upper surface 17 not only prevents the latch 3 from backward over-rotation, but also protects the ejecting portion 34 and the engaging block 13 from being damaged due to an unusually large operating force therebetween. The latch 3 has a protrusion 33 formed on the main body 30 and positioned between the stopping plate 32 and the stopping device 31. The Protrusion 33 locks with the cavity 123 of the standoff 12 to retain the latch 3 when the latch 3 is at the first position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for receiving a module, comprising:

an elongated insulative housing having a pair of elongated side walls, a central slot extending therebetween and along a lengthwise direction for insertion of the module, a receiving slot formed on one of the side walls and communicating with the central slot, the receiving slot extending along a transverse direction perpendicular to the lengthwise direction;

a plurality of terminals positioned in the side walls and extending into the central slot; and a latch being received in the receiving slot and being rotatable perpendicularly to the lengthwise direction for locking the module in the insulative housing at a first position and for ejecting the module out of the insulative housing at a second position, the latch having a main body and a stopping device projecting from the main body to abut against an upper surface of the insulative housing, thereby preventing the latch from over-rotation.

2. The card edge connector as claimed in claim 1, wherein the insulative housing has a pair of holes communicating with the receiving slot, the main body of the latch has a pair of spindles formed on opposite sides thereof to be rotatably received in the holes.

3. The card edge connector as claimed in claim 1, wherein the stopping device has a horizontal surface abutting against the upper surface of the insulative housing when the latch is at the first position.

4. The card edge connector as claimed in claim 3, wherein the stopping device has a slanted surface extending obliquely and upwardly from an end of the horizontal surface and abutting against the upper surface of the insulative housing when the latch is at the second position.

5. The card edge connector as claimed in claim 1, wherein the insulative housing has a standoff extending upwardly from the upper surface thereof, the stopping device has an upright surface abutting against a rear surface of the standoff when the latch is at the first position.

6. The card edge connector as claimed in claim 5, wherein the latch has a stopping plate formed on the main body and above the stopping device to abut against the standoff when the latch is at the first position.

7. The card edge connector as claimed in claim 6, wherein the standoff has a backstop extending upwardly from a top surface thereof, the stopping plate abuts against a rear surface of the backstop when the latch is at the first position.

8. The card edge connector as claimed in claim 7, wherein the upper surface of the insulative housing, the rear and top surface of the standoff commonly present as a ladder shape.

9. The card edge connector as claimed in claim 8, wherein the standoff has a cavity, the main body of the latch has a protrusion for locking with the cavity.

10. The card edge connector as claimed in claim 1, wherein the insulative housing has an engaging block extending into the central slot and defining an oblique surface, the main body of the latch has at least a locking portion extending therefrom for locking the module into the receiving slot, and an ejecting portion extending into the central slot for ejecting the module out of the insulative housing and abutting against the oblique surface of the engaging block when the latch is at the second position.

11. A card edge connector for receiving a module, comprising:

an elongated insulative housing having a pair of elongated side walls, a central slot extending therebetween for insertion of the module, a receiving slot formed on one of the side walls and communicating with the central slot;

a plurality of terminals positioned in the side walls and extending into the central slot thereof; and a latch rotatably engaging with the receiving slot, the latch having a main body, an actuating portion for urging the latch, an ejecting portion for ejecting the module out of the insulative housing, and a first and a second locking portion both for locking the module in the insulative housing; wherein the first locking portion extends from a front surface of the main body, the second locking portion extends from a side of the actuating portion to be positioned above the first locking portion.

12. The card edge connector as claimed in claim 11, wherein the side wall has a pair of holes communicating with the receiving slot, the latch has a pair of spindles formed on opposite sides thereof for being rotatablely received into the holes.

13. The card edge connector as claimed in claim 11, wherein the insulative housing has a standoff extending upwardly from an upper surface thereof, the latch has a stopping plate extending from one side of the main body and abutting against the standoff for preventing the latch from forward over-rotation, the actuating portion extends forwardly from an upper end of the stopping plate.

14. The card edge connector as claimed in claim 13, wherein the standoff present as a ladder shape and includes an upper step to abut against the stopping plate and a lower step defining a cavity at an inner side thereof, the main body of the latch has a protrusion protruding from the same side thereof as the stopping plate for locking within the cavity.

15. The card edge connector assembly as claimed in claim 14, wherein the main body has a stopping device protruding from the same side thereof as the protrusion to abut against the lower step when the latch is rotated forwardly for locking the module in the insulative housing.

16. A card edge, connector assembly comprising:

an insulative elongated housing defining an elongated central slot along a lengthwise direction with a locking tower at one lengthwise end;

an ejector pivotally mounted to said tower and rotable about a pivot axis extending along said lengthwise direction;

an upper latch and a lower latch formed on the ejector;

a printed circuit board assembled into the central slot and defining a notch in a side edge; wherein the upper latch engages an upper edge of the printed circuit board, the lower latch is engaged within the notch; wherein the upper latch extends outwardly along said lengthwise direction beyond the side edge with a distance essentially constantly terminated at an end wall of the tower.

17. The card edge connector assembly as claimed in claim 16, wherein the central slot is defined between two side walls of the housing under a condition that the pivot axis is located essentially outwardly offset from and outside of the corresponding side wall.

18. The card edge connector assembly as claimed in claim 16 wherein said ejector includes a main body with an oblique section located between the upper latch and the lower latch under condition that the oblique section abuts against the side edge in said lengthwise direction for retaining the printed circuit board.

* * * * *